United States Patent [19]

Morane et al.

[11] Patent Number: 4,978,035

[45] Date of Patent: Dec. 18, 1990

[54] NOZZLE FOR DISPENSING A PRODUCT, IN PARTICULAR A FOAMING PRODUCT

[75] Inventors: Bruno Morane, Neuilly; Gérard Joulia, Paris, both of France

[73] Assignee: L'Oreal, Paris, France

[21] Appl. No.: 439,975

[22] Filed: Nov. 21, 1989

[30] Foreign Application Priority Data

Nov. 21, 1988 [FR] France ..... 8815100

[51] Int. Cl.[5] ..... B65D 83/14

[52] U.S. Cl. ..... 222/108; 222/148; 222/402.13; 239/337; 239/573

[58] Field of Search ..... 222/108, 148, 206, 212, 222/215, 402.1, 402.12, 402.13, 402.21, 402.23; 239/112, 337, 573

[56] References Cited

U.S. PATENT DOCUMENTS

| | | | |
|---|---|---|---|
| 2,681,752 | 6/1954 | Jarrett et al. | 222/402.13 |
| 2,894,660 | 7/1959 | Gordon | 222/108 |
| 2,908,479 | 10/1959 | Goodspeed, Jr. | 222/402.13 X |
| 3,377,005 | 4/1968 | Marder | 222/402.13 |
| 3,578,220 | 5/1971 | Green et al. | 22/402.13 |
| 3,785,528 | 1/1974 | Mandeltort | 222/402.13 X |
| 4,034,427 | 7/1977 | Breznock et al. | 222/402.13 X |
| 4,901,891 | 2/1990 | Goncalves | 222/402.13 |

*Primary Examiner*—Kevin P. Shaver

*Attorney, Agent, or Firm*—Cushman, Darby & Cushman

[57] ABSTRACT

The present invention relates to a nozzle for dispensing a product, in particular a foaming product, contained in a pressurized container. The nozzle comprises three elements: an element (6) for fixation onto the container; a dispensing element (5); and a lateral element (7) for coupling the first two elements. The coupling element (7) has an elasticity such that its height varies between the operating position and the position of repose by a value equal to the sum of the distance between the upper edge of the emergent stem in the position of repose and the projection of the hole when the nozzle is in the position of repose, and the distance corresponding to the course of driving in of the emergent stem between its position of repose and the position of complete opening of the valve. The emergent stem of the valve, in the position of repose, is completely outside the hole.

7 Claims, 2 Drawing Sheets

NOZZLE FOR DISPENSING A PRODUCT, IN PARTICULAR A FOAMING PRODUCT

FIELD OF THE INVENTION

The present invention relates to a nozzle for dispensing a product, particularly a foaming product, contained in a pressurized container equipped with a valve with an emergent stem mounted in a valve cup.

BACKGROUND OF THE INVENTION

In a known manner, a dispensing nozzle for a pressurized container includes an element for fixation to the container. This element may for example be a device that catches or nests on the bead retaining the valve cup on the container. Also in a known manner, the nozzle includes an ejection tube, which may be in a plane perpendicular to the axis of the emergent valve stem or may form a small angle with respect to such a plane; this ejection tube communicates with the emergent valve stem via a hole having the same axis as the emergent valve stem. When the user presses on the dispensing nozzle to actuate the valve, the emergent stem is introduced into the hole up to a projection where the coupling between the valve and the wall of the hole is tight, and then the wall of the hole transmits the thrust exerted by the user to the emergent stem, in such a way as to depress the stem and open the valve.

When a foaming product is dispensed, the use of nozzles of this type has several disadvantages. First, a small quantity of the product in the form of foam remains in the ejection tube and in the hole after the dispensing is finished; this product has a tendency to liquefy and run along the walls of the tube and hole to reach the emergent stem of the valve, with the risk that when the foam dries, it will stop up the ejection tube and the emergent valve stem. Second, when the dispensing stops, the expansion of the foaming product continues in the interior and at the outlet of the ejection tube; a spot of foam thus forms at the outlet of the ejection tube after the dispensing, and this spot has a tendency to soil the walls of the container.

Numerous proposals have been made to solve these various problems. In particular, it has been proposed that the emergent stem be displaced in a hole having a shape such that the coupling between the stem and the hole is tight in the operating position, and not tight in the position of repose. Under these conditions, the product that remains in the ejection tube and hole is capable of running into the space between the valve cup and the dispensing nozzle. The lack of tightness may be obtained with the aid of grooves hollowed out in the hole, as described in U.S. Pat. No. 4,901,891, or by arranging the device such that in the position of repose the emergent stem of the valve will have exited completely from the hole.

However, the lack of tightness of the coupling between the emergent valve stem and the hole does not enable solving the problem of eliminating the spot of foam that forms at the outlet of the ejection tube and at corresponding fins. Moreover, this solution is not very satisfactory for viscous products or products heavily laden with solid material, such as makeup bases, which have a high pigment content.

In order not to have to form external fins, the proposal has been made in French Patent Application No. 87-09536 to assure that the opening of the ejection tube outlet is plugged in the position of repose, with the opening being uncovered only during operation. Moreover, it has also been proposed, in U.S. Pat. 3,785,528, that a negative pressure be created in the space above the valve cup inside the dispensing nozzle, in such a way that the product remaining after the dispensation in the ejection tube is aspirated into this space. However, the devices proposed thus far do not enable precise control of the suction, and consequently do not allow reliable reaspiration of the product remaining in the ejection conduit.

OBJECT AND SUMMARY OF THE INVENTION

The present application relates to a dispensing nozzle in which a negative pressure is created in a chamber included between the ejection tube and the valve cup, at the moment when the dispensing ceases, and in which the negative pressure created is controlled precisely.

The present invention relates to a nozzle for dispensing a product, in particular a foaming product, contained in a pressurized container equipped with a valve with an emergent stem mounted in a valve cup, the nozzle including:

(1) an element for fixation on the container;

(2) a dispensing element, including a hole, one projection of which is intended to receive the free end of the emergent valve stem in the operating position, when the user presses on the dispensing element, the hole having the same axis as the emergent stem which with it cooperates, and also including an ejection tube perpendicular to the axis of the hole, or slightly inclined with respect to a perpendicular to the axis, this ejection tube being in communication with the hole, and finally including a bearing surface enabling the action of the user upon the nozzle; and (3) a lateral coupling element between the fixation element and the dispensing element, characterized in that the dispensing element is entirely rigid, and that the coupling element is organized symmetrically with respect to the axis of the emergent stem and has an elasticity such that its height "h" can vary, between the operating position and the position of repose, by a value delta h equal to the sum of the distance delta h1, between the upper edge of the emergent stem in the position of repose and the projection of the hole when the nozzle is in the position of repose, and the distance delta h2, corresponding to the course of driving in of the emergent stem between its position of repose and the position of complete opening of the valve, the emergent stem of the valve, in the position of repose, being entirely outside the hole.

In a first variant, the coupling element comprises a bellows, the shape of which assures the necessary elasticity even if the material used has a relative rigidity.

In a second variant, the coupling element has the shape of a dome, and in this case it is made of an elastic plastic material such as polyethylene, polyvinyl chloride or the like.

The distance delta h is preferably between 2 mm and 15 mm, for nozzles having a diameter of 15 mm to 35 mm.

It may be provided that the dispensing element comprises a piece attached to the coupling element or molded in a single piece with the coupling element. Preferably, the fixation element and the coupling element are in one piece.

The function of the nozzle according to the present invention is as follows. When the user presses on the rigid dispensing element, the height of the coupling element is progressively diminished, and consequently the diminution of the volume of the chamber included inside the nozzle above the valve cup is effected. Simultaneously, the hole is displaced toward the valve stem and then depressed onto the valve stem until the stem comes to a stop at the projection surrounding the hole; then the projection brings about the driving in of the emergent valve stem, and dispensing of the product begins. When the user stops pressing on the dispensing element, the emergent stem of the valve rises again; the wall of the hole is disengaged from the emergent valve stem, and because of its elasticity the lateral coupling element duly resumes its initial height. The increase in volume of the chamber defined inside the nozzle between the valve cup, the dispensing element and the coupling element, generates a negative pressure. This negative pressure is well controlled because the user presses on a rigid surface, and the diminution in volume of the chamber duly takes place over the entire cross section thereof; the irregularities due to the manner in which the user presses on the dispensing element, irregularities that exist in the case where the dispensing element is not entirely rigid, are thus eliminated. Moreover, the symmetry of the coupling element with respect to the axis of the valve brings about a substantially axial deformation, such that the hole of the dispensing element adjusts correctly on the emergent stem at the end of the deformation. The negative pressure brings about the aspiration of the product contained in the ejection conduit, that is, in the ejection tube and hole; the product drains into the interior of the chamber. Under these conditions, the aspirated product dries progressively; by the time of a later use, the product is dried, but the dry extract stays inside the chamber and does not impede the dispensing process.

For better comprehension of the subject of the invention, two embodiments of purely illustrative and non-limiting nature will be described as shown in the drawings.

DESCRIPTION OF THE PREFERRED EMBODIMENTS

Figure 3:
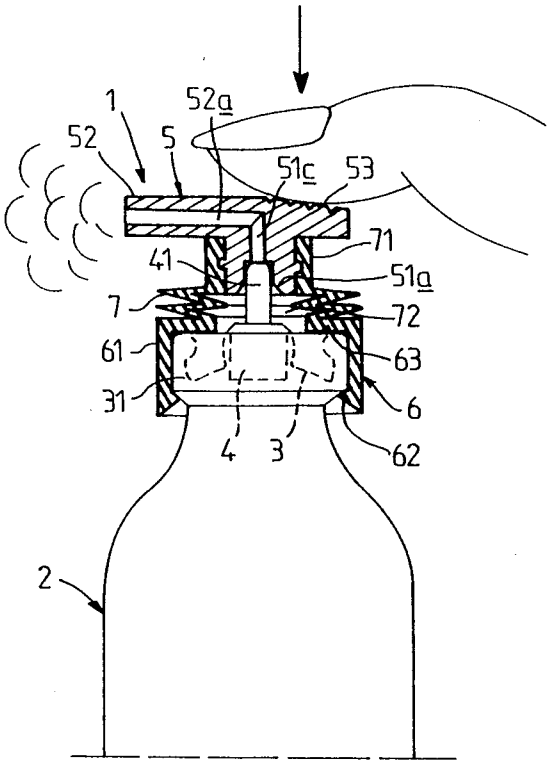
FIG. 3 shows the nozzle of FIG. 2 in the operating position.
Figure 2:
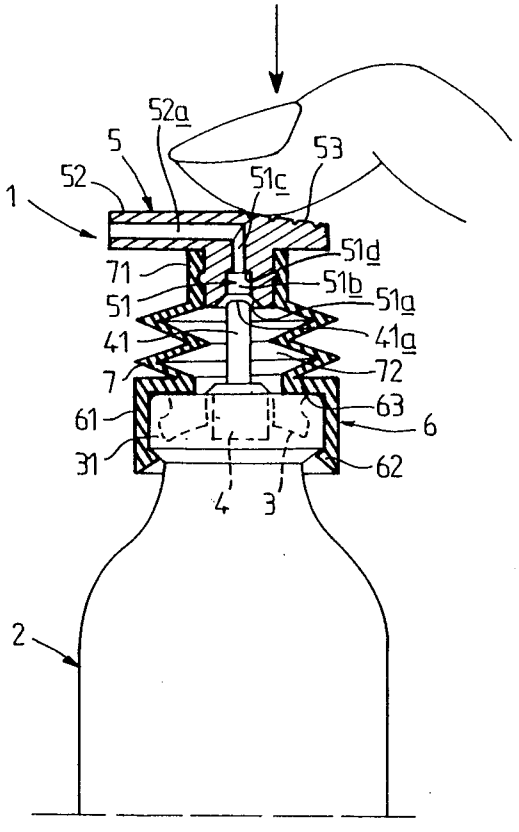
FIG. 2, in vertical axial section, shows the nozzle of FIG. 1 when the user begins to press on the dispensing element.
Figure 1:
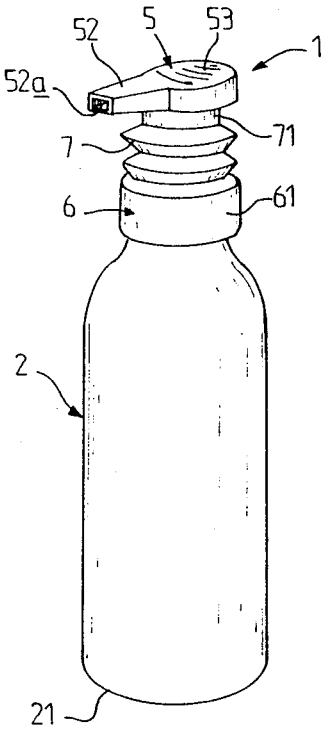
FIG. 1 is a perspective view of a first embodiment of a nozzle of according to the invention, fixed on a pressurized container.

As can be seen in FIGS. 1–4, the dispensing nozzle 1 is fixed on a pressurized container 2 of generally cylindrical shape. The container 2 includes bottom 21 and is closed at the end opposite the bottom 21 by a valve cup 3, which is affixed to the container 2 by a bead 31. The dispensing valve 4 is disposed in the center of the valve cup and axially includes an emergent stem 41. The nozzle 1 comprises three elements: a dispensing element 5, a fixation element 6 and a lateral coupling element 7, which joins the dispensing element and the fixation element.

The dispensing element 5 is molded of a rigid plastic material; it includes an axial hole 51 that in axial displacement from the inside to the outside of the nozzle includes a frustoconical portion 51*a*, followed by a cylindrical portion 51*b* having an internal diameter slightly greater than the outer diameter of the valve stem 41, and a portion 51*c* of a diameter smaller than the portion 51*b*, so as to form an annular projection 51*d* that serves as a sealed stop for the emergent stem 41. The dispensing element 5 also includes an ejection tube 52, the internal conduit 52*a* of which communicates with the hole 51. Located above the dispensing element 5 is a bearing surface 53, on which the user can press to actuate the dispensing nozzle. The fixation element 6 is caught or racheted on the retaining bead 31 of the valve cup on the container 2. The fixation element 6 comprises a cylindrical skirt 61 including, toward the container 2, a rachet bead 62 disposed under the bead 31, and toward the dispensing element 5 an annular plane portion 63, which rests on the edge of the valve cup 3.

The lateral coupling element 7 comprises a bellows made for example of a flexible, elastically deformable plastic material. In the embodiment described, the fixation element 6 and the lateral coupling element 7 are molded in one piece. The coupling element 7, in its upper portion, includes a cylindrical portion 71, nested in which is the dispensing element 5, which is molded separately of rigid plastic material. The lateral coupling element 7 defines a chamber 72 on the inside.

The apparatus functions as follows:

When the user wishes to actuate the dispensing nozzle, the user presses with one finger on the bearing surface 53 of the dispensing element. This depresses the dispensing element 5, which consequently causes the diminution of the height of the coupling element 7, with the accordion-like portions folding onto one another. At the same time, the upper edge of the emergent stem 41 penetrates the portion 51*a* of the hole and then the portion 51*b*. When it arrives at the bottom of the portion 51*b*, the emergent stem rests against the annular projection 51*d* that exists because of the fact that the portion 51*c* has a smaller diameter than the portion 51*b*; the upper edge 41*a* of the emergent rod thus comes to a stop against the projection 51*d*. The thrust exerted by the user then brings about the driving in of the valve stem 41, which causes the opening of the valve 4. In proportion with the lessening in height of the chamber 72, air is ejected via the hole 51 and the ejection tube 52. When the step 41 is depressed completely, the height of the lateral chamber has diminished by a value delta h (see FIG. 4), which is the sum of the distance delta h1 measured in the position of repose between the upper edge 41*a* of the emergent stem and the projection 51*d* of the hole, and the distance delta h2 corresponding to the path of driving in of the emergent rod. When the user relaxes the pressure on the bearing surface 53, the chamber 72 duly resumes its initial volume because of the resilient elasticity of the lateral coupling element; this creates a negative pressure in this chamber 72. The variation in volume of the chamber 72 does not depend on how the user presses on the dispensing element, but solely on the final position of the dispensing element, which is always the same. The negative pressure is thus reliably reproducible; it brings about the aspiration of the products that would remain in the conduit 52*a* of the ejection tube and in the hole 51; the liquid drops into the chamber 72. The variation in pressure is reliable and reproducible, and hence this suction is always possible in proportion to the variation in volume of the chamber, or in other words on the condition that the variation in height delta h has been suitably determined. In the embodiment shown, the height variation delta h is 10 mm, for example, for an internal chamber diameter of 25 mm. If a relatively long time elapses between two successive actuations, it is possible that the aspirated liquid may have dried; in that case, only a dry solid remains in the chamber 72, but its presence is not a hindrance to the course of distribution. The nozzle shown in FIGS. 1–4 allows unproblematic dispensing of foaming makeup bases having a content of dry material of approximately 300 g 1.

Figure 6:
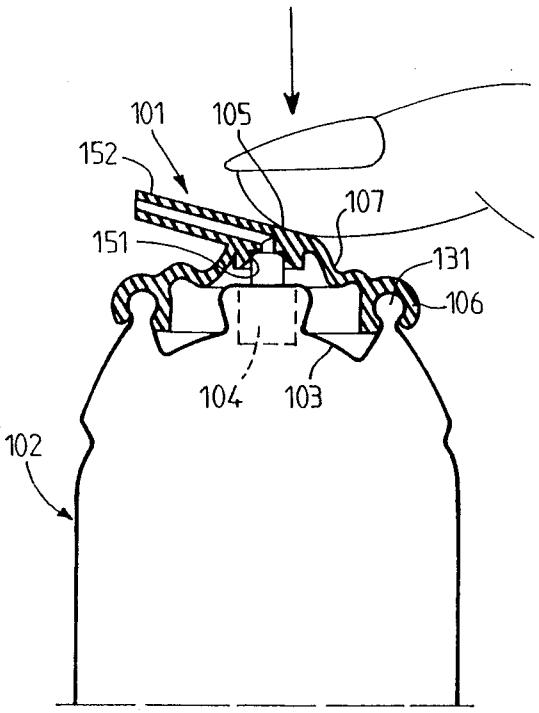
FIGS. 5 and 6, in axial vertical section, show a second embodiment of the nozzle according to the invention, in the position of repose (FIG. 5) and in the dispensing position (FIG. 6).
Figure 5:
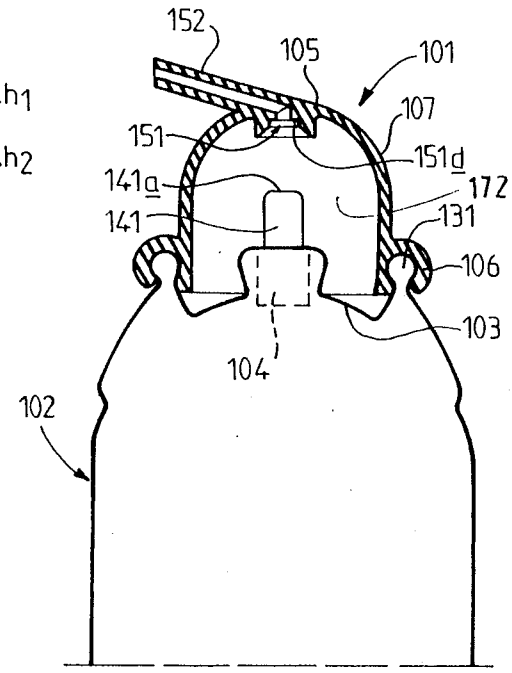
Figure 4:
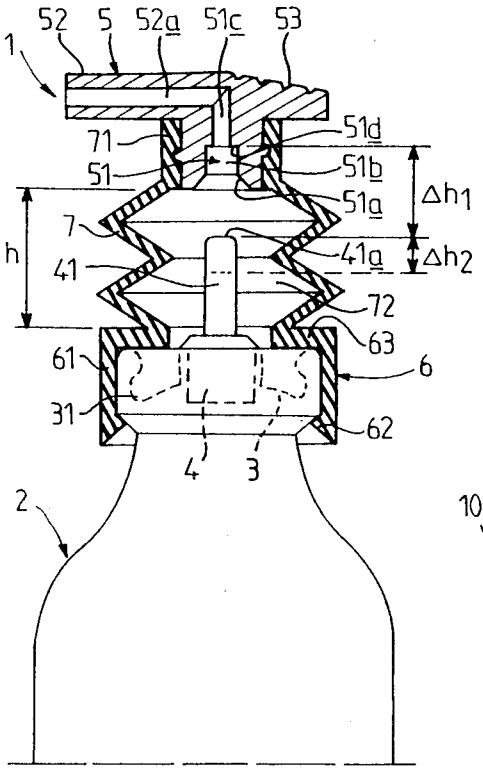
FIG. 4 shows the nozzle of FIG. 2 in the position of repose.

FIGS. 5 and 6 show a second embodiment of a dispensing nozzle according to the present invention. Constituent elements that are similar to or have a similar function to those described in conjunction with FIGS. 1–4 are identified by the same reference numerals, raised by 100, as those used for the corresponding elements in FIGS. 1–4. Hence they will be merely briefly described below.

In this embodiment, the dispensing nozzle 101 includes a dispensing element 105, a fixation element 106 clipped onto the container 102, and a lateral coupling element 107 joining the fixation element 106 to the dispensing element 105. The dispensing element 105 includes a hole 151 and a dispensing tube 152, which is inclined slightly with respect to a plane perpendicular to the axis of the emergent stem 141 of the valve 104. The fixation element 106 is obtained by molding the dispensing element 105 in a single piece with the lateral coupling element 107. The fixation element 106 includes two circular skirts having the same axis as the emergent stem 141, which enable it to catch on the fixation bead 131 of the valve cup 103 on the container 102. The lateral coupling element 107 has the shape of a thin dome that is susceptible to elastic deformation. This nozzle is made of elastic material, such as polyethylene, and the rigidity of the dispensing element 105 is obtained by providing a sufficient excess thickness of material in the zone on which the user presses.

FIG. 5 shows the nozzle in the position of repose, and FIG. 6 shows the nozzle in the operating position when the user has pressed on the dispensing element 105 until the valve 104 opens. Once again in this case, the variation in volume of the chamber 172 does not depend on how the user presses on the dispensing device 105; this variation in volume is controllable and is reliably reproducible because of the symmetry of the deformable portion of the nozzle and the rigidity of the dispensing nozzle on which the user presses. It is thus possible to aspirate the liquid remaining in the ejection tube 152 and hole 151 at any time, even with thick liquids.

What is claimed is:

1. A nozzle for dispensing a product, in particular, a foaming product, contained in a pressurized container of the type having a valve including a valve operating stem having a free end and being movably mounted in a valve cup mounted on the container, said nozzle including fixing means for attaching said nozzle on the container;

a dispensing element having conduit means for dispensing the product from said operating stem and having a dispensing outlet at one end thereof and, at the other end thereof, wall means defining a receiving hole for receiving a portion of the operating stem, said conduit means having an interior surface which is uninterrupted between said outlet and said wall means, said wall means having a projecting portion for engaging the free end of the stem, said dispensing element having a bearing surface on which a user presses to commence the dispensing operation;

coupling means connecting said dispensing element to said fixing means;

wherein said coupling means substantially symmetrically encloses a volume between said fixing means and said dispensing element and is elastically deformable so that the distance between said dispensing element and said stem can be reduced corresponding to movement induced during the dispensing operation by a user pressing on said bearing surface between a state of repose and an actuated state in which said wall defining said hole slidably contacts the stem and said projecting portion is moved through a first distance to engage the free end of the operating stem and through a further distance to move the operating stem from a position of repose to a position where the valve is opened, said dispensing element being made of a material that remains undeformed throughout said dispensing operation, said projecting portion and said hole being spaced from the free end of the stem when said coupling means is undeformed in said state of repose.

2. The nozzle of claim 1, characterized in that the coupling means comprises a bellows.

3. The nozzle of claim 1, characterized in that the coupling means is a hollow body of elastic plastic material.

4. The nozzle of one of claims 1–3, characterized in that the first and further distances between said projection of said dispensing element and the free end of the stem in the actuated position thereof is between 2 mm and 15 mm, for nozzles having a diameter of 15 mm to 35 mm.

5. The nozzle of claim 1, characterized in that the dispensing element has a part attached to the coupling means.

6. The nozzle of claim 1, characterized in that the dispensing element is molded in one piece with the coupling means.

7. The nozzle of claim 1, characterized in that the fixing means forms a single piece with the coupling means.

* * * * *